US007449087B2

(12) United States Patent
Odajima et al.

(10) Patent No.: US 7,449,087 B2
(45) Date of Patent: Nov. 11, 2008

(54) PRODUCTION MOLD FOR FORMED FIBER

(75) Inventors: Shingo Odajima, Tochigi (JP); Tokihito Sono, Tokyo (JP); Koichi Sagara, Tokyo (JP); Hiromichi Kimbara, Tochigi (JP)

(73) Assignee: Kao Corporation, Tokyo (JP)

( * ) Notice: Subject to any disclaimer, the term of this patent is extended or adjusted under 35 U.S.C. 154(b) by 473 days.

(21) Appl. No.: 10/484,809

(22) PCT Filed: Nov. 13, 2002

(86) PCT No.: PCT/JP02/11849

§ 371 (c)(1),
(2), (4) Date: Jul. 6, 2004

(87) PCT Pub. No.: WO03/095746

PCT Pub. Date: Nov. 20, 2003

(65) Prior Publication Data

US 2004/0241274 A1 Dec. 2, 2004

(30) Foreign Application Priority Data

May 10, 2002 (JP) ..... 2002-135573

(51) Int. Cl.
*D21F 13/00* (2006.01)

(52) U.S. Cl. ..... 162/218; 162/227; 162/220; 162/223; 162/230; 425/84; 264/87

(58) Field of Classification Search ..... 162/218, 162/227, 220, 223, 224, 228, 230; 425/84; 264/87

See application file for complete search history.

(56) References Cited

U.S. PATENT DOCUMENTS 6,468,398 B1 * 10/2002 Kumamoto et al. ..... 162/220

FOREIGN PATENT DOCUMENTS

| | | | |
|---|---|---|---|
| EP | 1439264 | * | 7/2004 |
| JP | 78600 | | 10/1928 |
| JP | 52-128412 | | 10/1977 |
| JP | S52-128412 | * | 10/1977 |
| JP | 2000-239998 | | 9/2000 |
| JP | 2001-32198 | | 2/2001 |
| JP | 2001-106220 | | 4/2001 |
| JP | 2001-235858 | * | 3/2002 |
| JP | 2002-88700 | | 3/2002 |
| WO | 99/42659 | | 8/1999 |

* cited by examiner

*Primary Examiner*—Mark Halpern
(74) *Attorney, Agent, or Firm*—Oblon, Spivak, McClelland, Maier & Neustadt, P.C.

(57) ABSTRACT

A method of producing a fiber molded article using a pressing mold, includes inserting a first split and a second split into a slurry tank such that a fiber layer is formed on the first split and a fiber layer is formed on the second split, placing the pressing mold, which includes a solid elastic member and an inflatable elastic member configured to be inflated, onto the fiber layer on the first split, joining the first split and the second split such that a fiber molded article is formed from the fiber layer on the first split and the fiber layer on the second split, and dewatering and shaping the fiber molded article by pressing the fiber molded article by the solid elastic pressing member and the inflatable elastic pressing member.

9 Claims, 10 Drawing Sheets

11a
11b
9
90
11
C
10
10a
22
61
6
23
231
31
32
111
10e
62

1
3
7
2

1
6
7
220
221
P 1
7
10

PRODUCTION MOLD FOR FORMED FIBER

This application is a 371 of PCT/JP02/11849 filed on 13 Nov. 2002.

TECHNICAL FIED

The present invention relates to a pressing mold for producing a fiber molded article and a method of producing a fiber molded article using the same.

BACKGROUND ART

Known techniques pertaining to production of a pulp molded article using two kinds of cores include Japanese Patent 78600. The patented technique comprises arranging a solid core and a bag-like core in an outer mold (papermaking mold), accumulating pulp fiber on the papermaking surface of the outer mold to form a wet molded article, supplying a prescribed fluid in the bag-like core to expand it, pressing the molded article by the expanded core toward the papermaking surface to dewater the molded article. The molded article is removed from the mold and dried to obtain a molded article of prescribed shape.

According to this pulp molded article production method, the part of the molded article that has an increased density by pressing with the bag-like pressing member exhibits high strength. However, the other part is liable to become uneven in thickness and density and, after dewatering and drying, the molded article tends to suffer from thickness or density variation and resultant non-uniformity in physical properties such as strength.

The technique disclosed in JP-A-2000-239998, which relates to production of a pulp molded article, makes it possible to produce a hollow pulp molded article of a complicated shape. There is a demand for establishing means for making a fiber molded article of a complicated shape, particularly a fiber molded article having a partial protrusion or a wide opening, at a precise shaping with minimized variation in thickness and density. In manufacturing a molded article of a complicated shape, since the pressing member used to press a molded article has poor durability due to partial inflation, it has been desirous of a durable mold for producing a fiber molded article.

Accordingly, an object of the present invention is to provide a high durable pressing mold for producing a fiber molded article having a complicated shape, particularly having a partial protrusion or a wide opening portion at a high precise shaping with minimized variation in thickness; and a method of producing a fiber molded article using such a pressing mold.

DISCLOSURE OF THE INVENTION

The object of the present invention is achieved by providing a pressing mold for producing a fiber molded article which presses a fiber molded article toward the surface of a shaping mold to shape by a dewatering and a drying. The pressing mold of the present invention comprises a solid first elastic pressing member and a hollow second elastic pressing member which press the fiber molded article toward the surface of the shaping mold. The second elastic pressing member is inflatable by a fluid fed into the inside.

The object of the present invention is also achieved by providing a method of producing a fiber molded article using the pressing mold according to the present invention, which includes at least the step of dewatering and shaping or of drying and shaping which comprises setting the pressing mold on the surface of a fiber molded article placed on the surface of a shaping mold, pressing the fiber molded article by the first elastic pressing member toward the surface of the shaping mold, and feeding a fluid into the second elastic pressing member to press part of the fiber molded article toward the surface of the shaping mold.

BRIEF DESCRIPTION OF THE DRAWINGS

FIG. 4(*c*) is the step of drying and shaping by the first elastic pressing member and the second elastic pressing member, and FIG. 4(*d*) shows the fiber molded article and the pressing mold after mold release.

BEST MODE FOR CARRYING OUT THE INVENTION

The present invention will be described with reference to its preferred embodiments by referring to the accompanying drawings.

Figure 1:
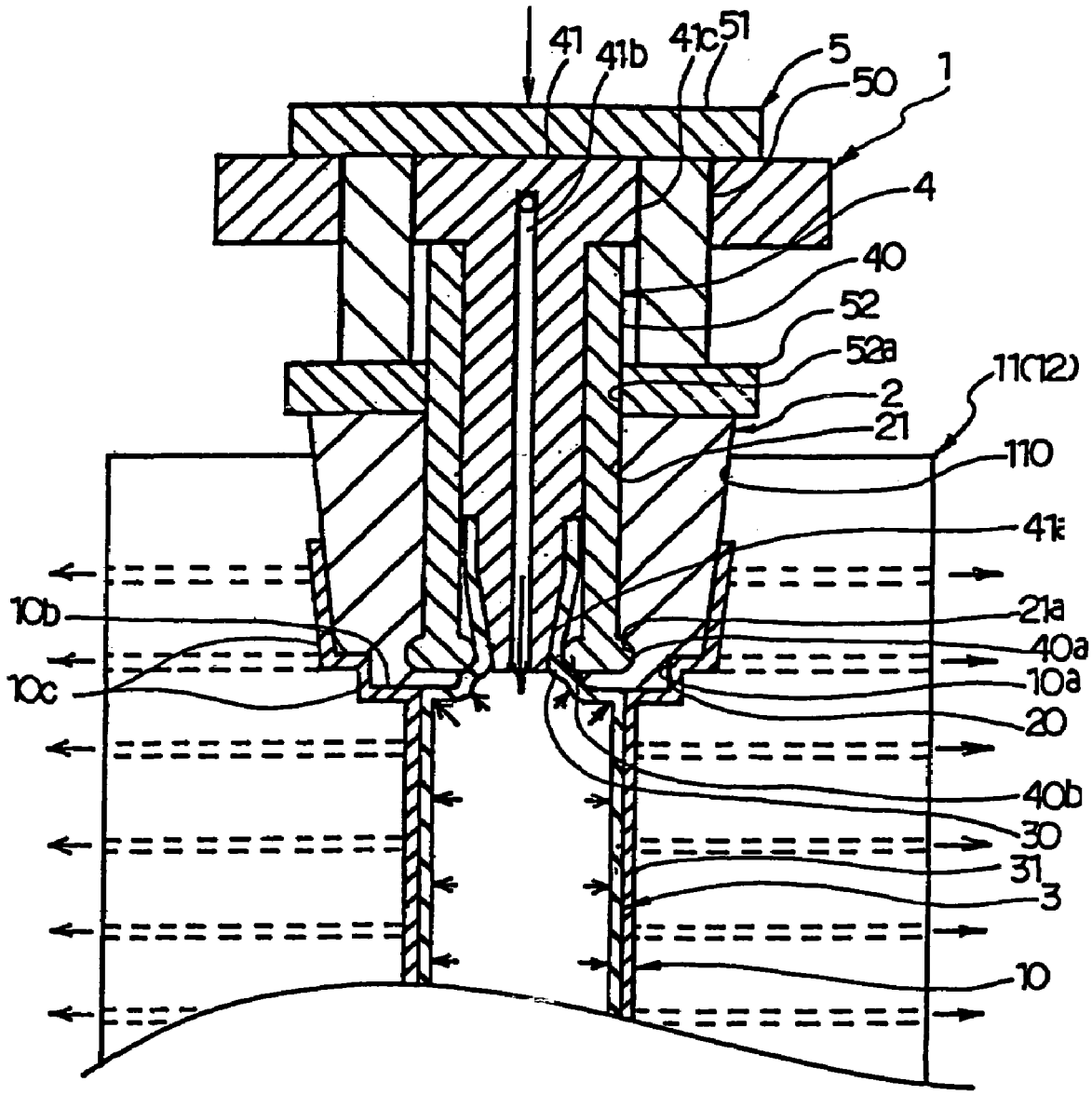
FIG. 1 is a schematic cross-section of an essential part of the pressing mold according to a first embodiment of the present invention in its state of working.
Figure 2:
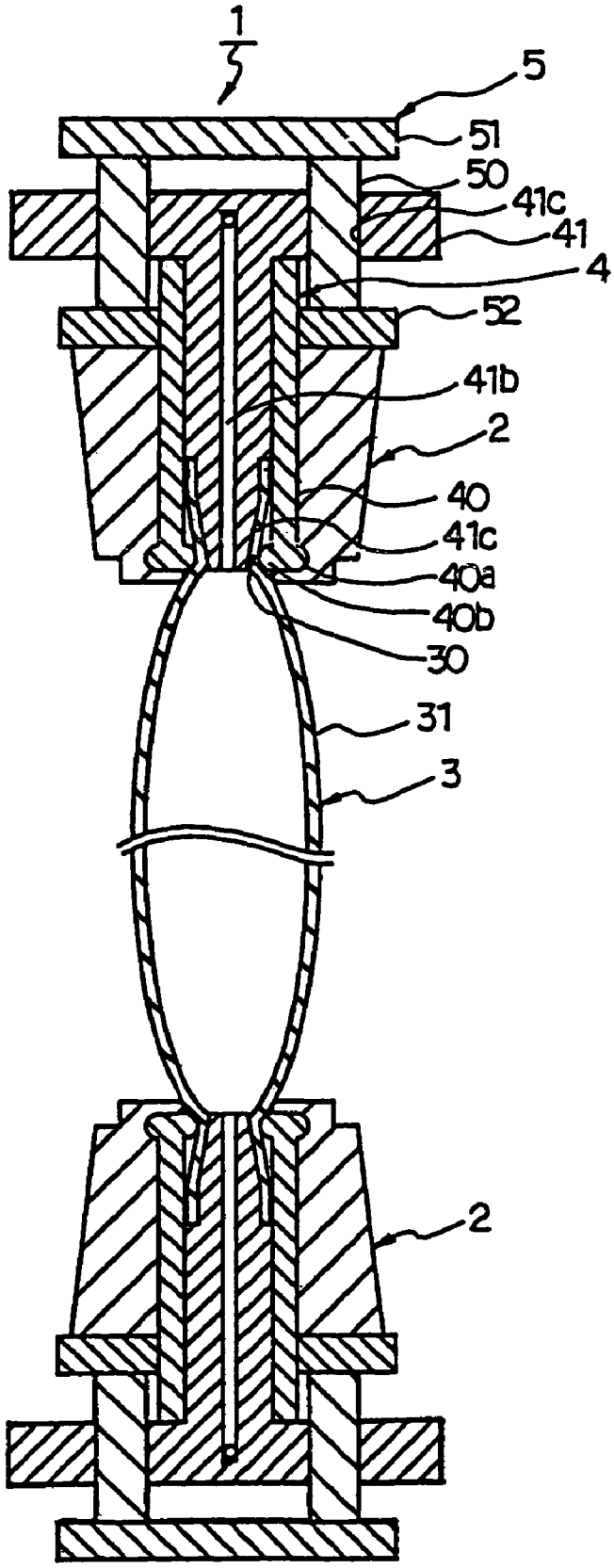
FIG. 2 is a schematic cross-section of the pressing mold according to the first embodiment.
Figure 3A:
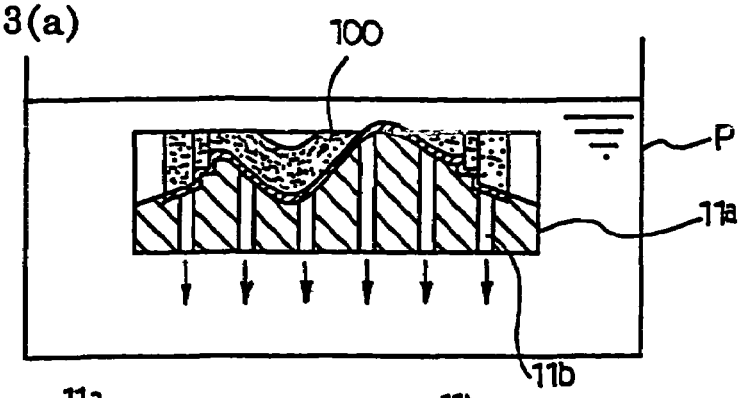
FIGS. 3(*a*) through (*d*) are schematic partial cross-sections of the steps in an embodiment of applying the method of producing a fiber molded article according to the present invention to production of a fiber molded hollow article; in which FIG. 3(*a*) is the step of making a fiber layer, FIG. 3(*b*) shows splits joined together, FIG. 3(*c*) is the step of dewatering and shaping by a first elastic pressing member, and FIG. 3(*d*) is the step of dewatering and shaping by the first elastic pressing member and a second elastic pressing member.
Figure 3B:
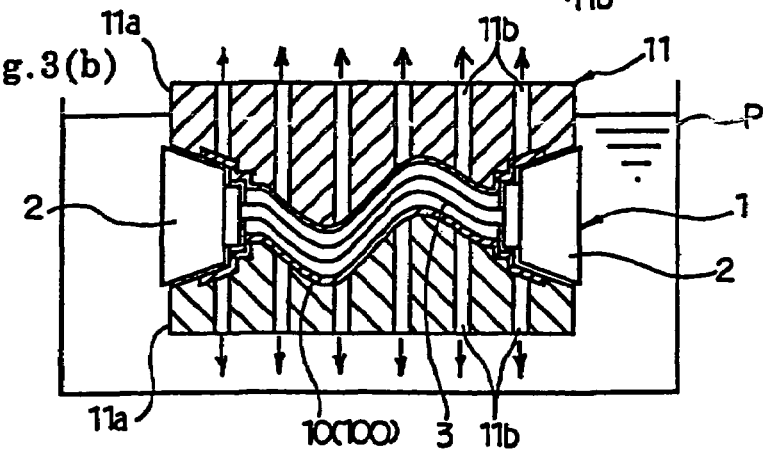
Figure 3C:
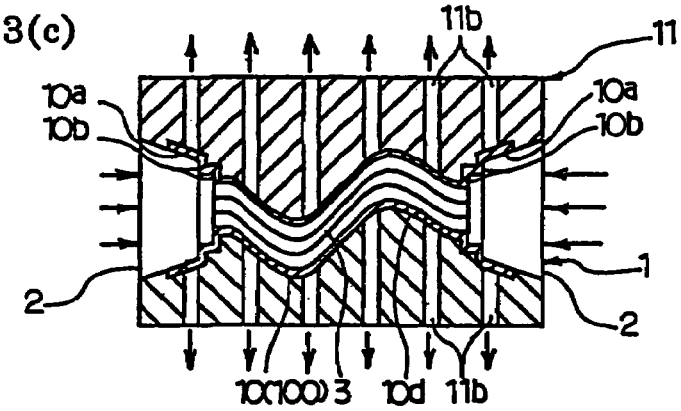
Figure 3D:
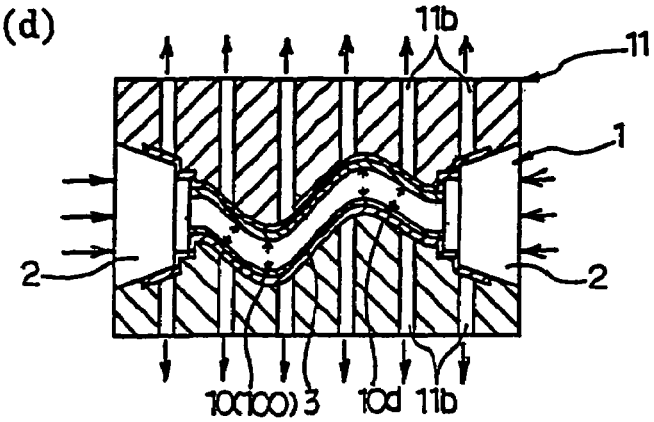
Figure 4A:
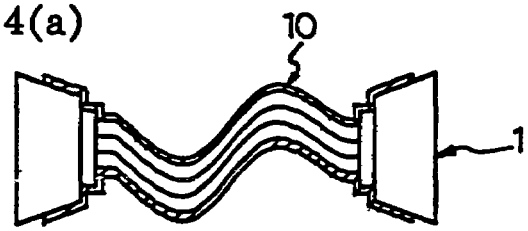
FIGS. 4(*a*) through (*d*) are schematic partial cross-sections of the steps in the production according to the embodiment of FIG. 3; in which FIG. 4(*a*) shows transfer from the dewatering and shaping step to the drying and shaping step, FIG. 4(*b*) is the step of drying and shaping by the first elastic pressing member.
Figure 4B:
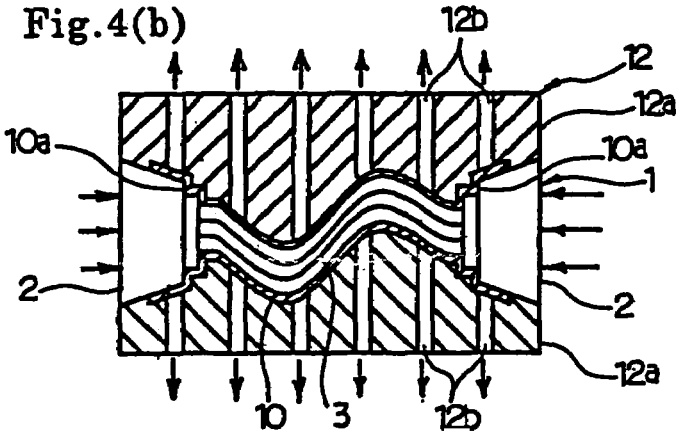
Figure 4C:
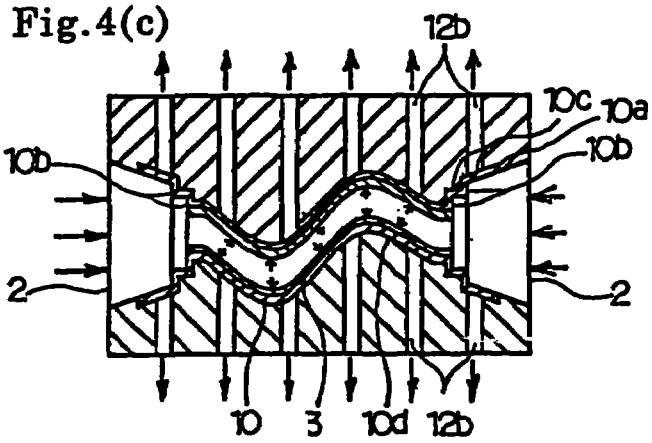
Figure 4D:
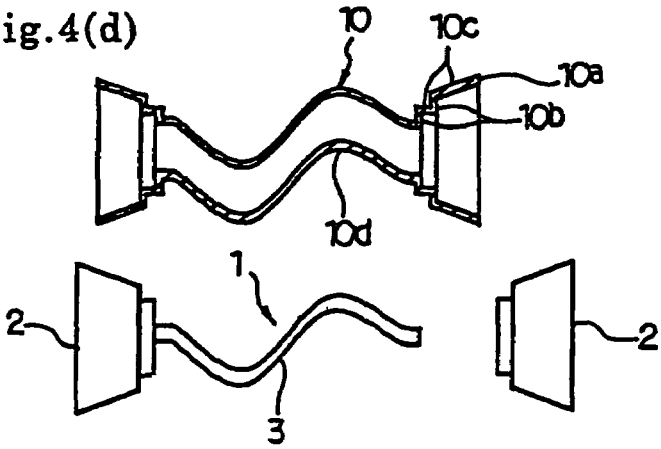

FIGS. 1 and 2 show a first embodiment of the pressing mold for producing a fiber molded article according to the present invention (hereinafter simply referred to as the pressing mold). The pressing mold of the first embodiment is applied to produce a hollow tubular fiber-molded article. In these figures numeral 1 indicates the pressing mold, 10 indicates a fiber molded article produced, 11 and 12 indicate a shaping mold for producing a fiber molded article to be placed in dewatering and shaping or in drying and shaping, respectively.

As illustrated in FIG. 1, the pressing mold 1 presses the fiber molded article 10 placed in the shaping mold 11 or 12 toward the inner wall (inner surface) of the shaping mold 11 or 12 to carry out shaping.

As shown in FIG. 2, the pressing mold 1 comprises a solid first elastic pressing members 2 (hereinafter also referred to as a solid elastic pressing member(s)) and a hollow and tubular second elastic pressing member 3 (hereinafter also referred to as a hollow elastic pressing member) which is inflatable by a fluid fed to the inside.

In the pressing mold 1 of this embodiment, the solid elastic pressing member 2 has a holding unit 4 (composed of a clamp core 40 and a clamp sleeve 41 as described infra) for holding an opening portion 30 of the hollow elastic pressing member 3 in its opened state. The inflatable portion 31 of the hollow elastic pressing member 3 inflates outwardly from the inside of the hollow elastic pressing member 2.

The pressing mold 1 according to the present embodiment has a pressing unit 5 which is capable of pressing the solid elastic pressing member 2 independently of the holding unit 4.

As shown in FIG. 1, the outer periphery of the solid elastic pressing member 2 tapers away. When the solid elastic pressing member 2 presses the fiber molded article 10 toward the inner surface of the shaping mold 11, the solid elastic pressing member 2 enables the opening portion of the fiber molded article 10 to form a taper shape with gradually altered diameter. The diameter of the tip of the solid elastic pressing member 2 is smaller than that of the other parts of the solid elastic pressing member 2. When the solid elastic pressing member 2 presses the fiber molded article 10 toward the inner surface of the shaping mold 11, the diameter of one end of the opening portion 10*a* alters discontinuously. The solid elastic pressing member 2 enables to be pressed from its rear side by the pressing unit 5 described infra.

The solid elastic pressing member 2 has a through-hole 21 in the inside and a clamp sleeve 40 (hereinafter described) is fitted in the through-hole 21. The inner peripheral wall of the through-hole 21 has a recess for the fitting 21*a* near the front end thereof. The clamp sleeve 40 has an outward flange 40*a*, which is fitted into the fitting recess 21*a*. By so doing, the lower end face of the clamp sleeve 40 is covered with the solid elastic pressing member 2, and the hollow elastic pressing member 3 is inflated outwardly from the front end of the solid elastic pressing member 2.

The contour size of the solid elastic pressing member 2 is smaller than the insertion opening 110 of the shaping mold 11 and the opening portion 10*a* of the fiber molded article 10, and the length of the smaller-diametered portion 20 of the solid elastic pressing member 2 is longer than the depth of the larger-diametered portion of the opening portion of the fiber molded article to be shaped. By this design, the solid elastic pressing member 2 can be smoothly put in and out of the shaping mold 11 and the fiber molded article 10 and easily released from the fiber molded article 10. While the contour size of the solid elastic pressing member 2 is smaller than the insertion opening 110 of the shaping mold 11 and the opening portion 10*a* of the fiber molded article 10, a close contact with every corner of the insertion opening 110 of the shaping mold 11 and the opening portion 10*a* of the fiber molded article 10 is achieved by the pressing force for shaping and the pressing force is securely transmitted to the fiber molded article 10.

The material of the solid elastic pressing member 2 is not particularly limited as long as it is elastic. From the standpoint of durability, heat resistance, moldability, etc., it is preferred to use natural rubber or synthetic rubbers such as urethane, fluororubber, silicone rubber, and elastomers.

As shown in FIG. 2, the hollow elastic pressing member 3 is a tubular hollow elastic member. The opening portion 30 of each end of the hollow elastic pressing member 3 is fixedly clamped between the inward flange 40*b* of the clamp sleeve 40 and the outer periphery 41*a* of the front part of the clamp core 41. The inward flange 40*b* is set in the solid elastic member 2 and the clamp core 41 is set in the clamp sleeve 40.

A preferred thickness of the hollow elastic pressing member 3 is from 0.3 to 5.0 mm, more preferably from 0.5 to 3.0 mm. Where the thickness of the hollow elastic pressing member 3 is highly decreased, it may break easily or may be subjected to a plastic deformation. Where the thickness of the hollow elastic pressing member 3 is highly increased, it may need too much pressure for inflation or may have difficulty in inflating up to every corner of the fiber molded article to be produced. This insufficient inflation of the hollow pressing member 3 may cause a failure of dewatering and shaping for production of a precise fiber molded article. The length, cross-sectional shape, and the like of the hollow elastic pressing member 3 can be selected appropriately according to the cross-sectional configuration of the fiber molded article 10 to be produced.

Similarly to the solid elastic pressing member 2, the hollow elastic pressing member 3, can be of any material with no particular limitation as long as it is elastic. From the standpoint of durability, heat resistance, moldability, etc., it is preferred to use natural rubber or synthetic rubbers such as urethane, fluororubber, silicone rubber, and elastomers.

The holding unit 4 is composed of the clamp sleeve 40 that is inserted into the through-hole 21 of the solid elastic pressing member 2 and the clamp core 41 that is set in the clamp sleeve 40 and fixed thereto with fasteners (not shown).

The front end of the clamp sleeve 40 has an outward flange 40*a* (stopper) which fits into the fitting recess 21*a* of the solid elastic pressing member 2. The outward flange 40*a* restricts the movement of the solid elastic pressing member 2 in the pressing direction when the solid elastic pressing member 2 is pressed. The outward flange 40*a* controls independently the pressing force exerted onto the steps 10*b* of the opening portion 10*a* of the fiber molded article 10 and the pressing force exerted onto the peripheral walls 10*c* of the opening portion 10*a* of the fiber molded article 10.

The clamp sleeve 40 has an inward flange 40*b* at its front end. The opening portion 30 of hollow elastic pressing member 3 is clamped between the inward flange 40*b* and the outer periphery 41*a* of the front part of the clamp core 41.

As shown in FIG. 1, the clamp core 41 has a fluid passage 41*b* in its inside. The fluid passage 41*b* leads to the outside. A fluid is fed into the inside of the hollow elastic pressing member 3 through the fluid passage 41*b*. The clamp core 41 has a protruded portion at its rear end, and the protruded portion has plural through-holes 41*c* which are located at the outside of the clamp sleeve 40. Connecting rods 50 of the pressing unit 5 (hereinafter described) are inserted through the through-hole 41*c* and moves along the vertical directions.

The pressing unit 5 is composed of the connecting rods 50 and two plates 51 and 52 each fixed to either end of each connecting rod 50 with a fastener (not shown). The plate 52 has a through-hole 52*a* in its center portion. The clamp sleeve 40 and the clamp core 41 are inserted into the through-hole 52*a* and move along the vertical directions. By this structure, when the plate 51 is pressed, the pressing force is transmitted to the solid elastic pressing member 2 through the connecting rods 50 and the plate 52. The clamp sleeve 40 and the clamp core 41 do not relate to the transmission of the pressing force. In spite of the fixing of the clamp core 41, the solid elastic pressing member 2 is expanded outwardly because the pressing force of the plate 51 presses the solid elastic pressing member 2 in the radial outward directions.

There is a prescribed gap between the plate 51 and the rear side of the clamp core 41. When the solid elastic pressing member 2 is pressed by the plate 51, the pressing force is transmitted only through the connecting rods 50 and the plate 52 and the solid elastic pressing member 2 expands outwardly. After the plate 51 reaches the rear side of the clamp core 41, the pressing force is transmitted to the solid elastic pressing member 2 through the clamp core 41 and the clamp sleeve 40 in addition to the connecting rods 50 and the plate 52. In this pressing process, the movement of the solid elastic pressing member 2 in the pressing direction is blocked by the outward flange 40*a* of the clamp sleeve 40. The outward flange 40*a* prevents excessive pressing of the steps 10*b* which is a contact face between the opening portion 10*a* of the fiber molded article 10 and the solid elastic pressing member 2. The solid elastic pressing member 2 expands outwardly in the radial direction and the peripheral walls 10*c* of the opening portion 10*a* is sufficiently pressed. In this way, a fiber molded article having a wide opening portion 10*a* is obtained since the shape of the shaping mold is precisely transferred to the fiber molded article to be produced.

According to the first embodiment, the solid elastic pressing member 2 and the hollow elastic pressing member 3 of the pressing mold 1 are used to press different parts of a molded article, e.g. used for the opening portion and the tubular portion. Therefore, the hollow elastic pressing member 3, which is used only for pressing the tubular portion, is uniformly inflated. As a result, the durability of the hollow elastic pressing member 3 is greatly improved.

Referring to the drawings, the method of producing a fiber molded article according to the present invention will then be described with a preferred embodiment in which a fiber-molded hollow article with a wide opening is produced using the above-described pressing mold 1.

First of all, a shaping mold composed of a pair of splits is prepared for papermaking and dewatering. Each split has a cavity-forming surface and forms shaping mold having a cavity in conformity to the contour of the fiber molded article to be molded when the parting faces of each split are mated together. The cavity-forming surface of each split is covered with a papermaking screen having predetermined mesh size and wire diameter, on which solid matter of a fiber slurry described later is to be deposited to form a fiber layer. Each split has many passageways interconnecting the cavity and the outside of the mold. The passageways are connected to a suction pipe leading to a negative pressure source so that the liquid of the fiber slurry may be drained through the passageways.

As shown in FIG. 3(*a*), each split 11*a* (only one split is illustrated in the figure) is immersed in the fiber slurry in a tank P. The fiber slurry is sucked through the passageways 11*b* of the split 11*a* to deposit a fiber layer 100 on the papermaking screen (not shown).

The fiber slurry preferably consists of pulp fiber and water. In addition to pulp fiber and water, the fiber slurry may contain other components, such as inorganic substances, e.g., talc and kaolinite, inorganic fibers, e.g., glass fiber and carbon fiber, particulate or fibrous thermoplastic synthetic resins, e.g., polyolefins, non-wood or plant fibers, and polysaccharides. The amount of these other components is preferably 1 to 70% by weight, particularly 5 to 50% by weight, based on the total amount of pulp fiber and said other components. The fiber slurry may also contain appropriate additives, is such as pulp fiber dispersants, molding assistants, colorants, coloring assistants, and antifungals. Sizing, pigments, fixatives, and the like may be added to the fiber slurry appropriately.

An esterified pulp may be used for the fiber of the fiber slurry. A mixture of the esterified pulp and an acrylic fiber may be used. The esterified pulp includes as disclosed in Japanese Patent Application No. 5200/77, phosphated cellulose fiber, phosphated polyvinyl alcohol fiber, and the like, which are obtained by esterifying natural cellulose or a derivative thereof or a synthetic fiber, e.g., polyvinyl alcohol. Such esterified pulp can be obtained by, for example, immersing the raw material, i.e., natural cellulose or its derivative or a synthetic fiber, e.g., polyvinyl alcohol, in a phosphating solution for a predetermined time, squeezing and drying the fiber, heating the fiber at an esterifying reaction temperature (about 140°), and cooling at room temperature. The phosphating solution is an aqueous solution of ammonium polyphosphate, which is prepared by the reaction between urea and phosphoric acid, having dissolved therein several percent of urea.

In the present invention, the papermaking screen made of natural fibers, synthetic fibers or metal fibers can be used alone or together. A screen composed of a combination of the above-recited materials is also useful. From the standpoint of easy weaving into a screen and durability, synthetic fibers are preferably used. The natural fibers include plant fibers and animal fibers. The synthetic fibers include synthetic resins, such as thermoplastic resins, thermosetting resins, and semi-synthetic resins. The metal fibers include stainless steel fiber and copper fiber. The surface of the fiber to be woven into a screen is preferably modified for improvement of slipping properties and durability. The papermaking screen preferably has an average open area ratio of 10 to 70%, particularly 25 to 55%, in order to avert intimate contact with the inner side of the split and thereby to assure satisfactory suction efficiency. In order to securely accumulate the solid component of the fiber slurry on the papermaking screen while preventing the solid from passing through the screen openings or clogging the openings, the average maximum opening width of the screen is preferably 0.1 to 1.5 mm, more preferably 0.3 to 1.0 mm.

As shown in FIG. 3(*b*), the splits 11*a* having formed the fiber layer 100 thereon are combined and the pressing mold 1 is set in the cavity formed by combining the splits 11*a*. In this stage, the hollow elastic pressing member 3 is not inflated. The pressing mold 1 is placed on the fiber layer formed on one of the splits 11*a* before the two splits 11*a* are joined together. The splits 11*a* are joined on their parting faces within the slurry. While the splits 11*a* are being joined, the fiber slurry continues being sucked through the passageways 11*b* to accumulate the fiber on the inner side of the joint seams between the fiber layers 100. By so doing, the resulting fiber molded article 10 becomes seamless and strong.

The pressing mold 1 set in the cavity presses the fiber layers 100 toward the inner wall of the shaping mold 11 thereby dewatering and uniting of the fiber layers are achieved.

As shown in FIG. 3(*c*), in the dewatering and shaping process, the fiber layers 100 are united by the solid elastic pressing member 2 and the opening portions 10*a*of the fiber molded article 10 are dewatered and shaped and after that the fiber layers 100 are united and the tubular portion 10*d* of the fiber molded article 10 is dewatered by the hollow elastic pressing member 3. Thus, dewatering and shaping by the solid elastic pressing member 2 is firstly performed and the dewatering and shaping by the hollow elastic pressing member 3 is secondary performed. Where the hollow elastic pressing member 3 inflates and firstly presses the fiber molded article 10, a part of the hollow pressing member 3 may enter into a gap between the inner surface of the fibers layers 100 and the solid elastic pressing members 2 and the pressing force of the solid elastic pressing member 2 may be insufficiently transferred to the corner of the opening portions 10*a* of the fiber molded article 10. The insufficiency of the pressing force may cause a production of the fiber molded article 10 having corners of the opening portion 10*a* of imprecise shape. The dewatering and shaping can be conducted either after (as shown in FIG. 3(*c*)) or while the pressing mold 1 and the shaping mold 11 are pulled up out the fiber slurry.

The pressing force of each solid elastic pressing member 2 applied for dewatering and shaping is chosen according to the fiber layer to be dewatered. It is preferably 0.1 to 3 MPa, more preferably 0.5 to 1 MPa.

Then, a fluid is fed into the hollow elastic pressing member 3 while the solid elastic pressing members 2 presses the fiber layer 100 as shown in FIG. 3(*d*). The hollow elastic pressing member 3 is inflated to press the fiber layers 100 toward the inner wall of the shaping mold 11. As a result, the body portions of the fiber layers 100 are united and the wet tubular portion 10*d* of the fiber molded article 10 is dewatered and shaped.

The fluid which can be used to inflate the hollow elastic pressing member 3 includes gases, such as air (pressurized air), hot air (heated and pressurized air), steam, and superheated steam, oil (heated oil), and other liquids. In particular, air, hot air or superheated steam is preferred from the viewpoint of dewatering efficiency and ease of operation. The pressure for feeding the fluid into the hollow elastic pressing member 3 is chosen according to the fiber layer to be dewatered. It is preferably 0.01 to 5 MPa, more preferably 0.1 to 3 MPa. Where the pressure is too low, the hollow elastic pressing member does not sufficiently inflate and therefore the inner shape of the shaping mold may be not transferred, a precise shaping and a sufficient dewatering may not be achieved. Where the pressure is too high, the fiber layer may be entangled in the papermaking screen, or the hollow elastic pressing member may open the shaping mold and a defective fiber molded article may be produced.

In the dewatering step, while the inflated hollow elastic pressing member 3 presses the fiber layers 100 toward the inner wall of the shaping mold 11, the water of the fiber layers 100 is sucked through the passageways 11*b*. By sucking the water from the fiber layers 100 through the passageways 11*b* and pressing by the hollow elastic pressing member 3, the fiber layers 100 are equally pressed from their inside and joined into one body. In this way, the fiber molded article 10 is rapidly dewatered and a uniform thickness is achieved.

When the fiber molded article 10 is dewatered to a prescribed water content, the suction through the passageways 11*b* is stopped, and, at the same time, the fluid is withdrawn from the hollow elastic pressing member 3 to let the hollow elastic pressing member 3 shrink. The shaping mold 11 is opened to remove the wet fiber molded article 10 containing the hollow elastic pressing member 3 from the shaping mold 11.

The water content of the fiber molded article 10 after the dewatering is preferably 40 to 90%, more preferably 50 to 80%, in view of prevention of damage during transfer to the drying step and dewatering efficiency.

After the dewatering, the wet fiber molded article 10 is moved without removing from the pressing mold 1 as illustrated in FIG. 4(*a*) and placed in a shaping mold 12 for drying before joining splits 12*a* as shown in FIG. 4(*b*).

The shaping mold 12 for drying has the same configuration as the shaping mold 11 for papermaking and dewatering except that it is equipped with a heating unit such as a heater (not shown) and is not equipped with a papermaking screen.

The shaping mold 12 is heated to a predetermined temperature with the heating unit. The temperature of the shaping mold 12 is preferably 100 to 250° C., more preferably 180 to 240° C., for averting scorching of the fiber molded article 10 and for drying efficiency.

On the other hand, as shown in FIGS. 4(*b*) and (*c*), the solid elastic pressing members 2 press the fiber molded article 10 to the inner wall of the shaping mold 12 to dry the opening portions 10*a*. Subsequently, a fluid is fed into the hollow elastic pressing member 3 to inflate the hollow elastic pressing member 3. The inflated hollow elastic pressing member 3 presses the tubular portion 10*b* of the fiber molded article 10 to the inner wall of the shaping mold 12, whereby the fiber molded article 10 is formed by drying with heating and pressing from the inside.

The pressing force of the solid elastic pressing members 2 to press the fiber molded article 10 in the step of drying and shaping is chosen according to the fiber molded article to be dried and shaped. It is preferably 0.2 to 3.0 MPa, more preferably 0.4 to 1.5 MPa. Where the pressing force is to low, the shape of the inner wall of the shaping mold may not be sufficiently transferred to the fiber molded article 10, the shaping performance may become poor, and the drying efficiency may be decreased. Where the pressing force is too high, the solid elastic pressing member 2 may be broken or the drying mold may be opened. They cause shaping defects.

The pressure for feeding a fluid into the hollow elastic pressing member 3 is chosen according to the fiber molded article to be dried and shaped. It is preferably 0.01 to 5 MPa, more preferably 0.1 to 3 MPa. Where the pressure is too low, the hollow elastic pressing member 3 may not sufficiently inflate for drying and shaping of the fiber layer and the inner shape of the shaping mold may not be transferred to the fiber molded article. They cause a failure in precise shaping and sufficient drying in a short time. Where the fluid feed pressure is too high, the hollow elastic pressing member 3 may open the shaping mold 12, and therefore shaping defects may be occurred. The fluids employed in the dewatering and shaping step can be used to inflate the hollow elastic pressing member 3.

In the step of drying and shaping, drying is carried out by sucking the water of the fiber molded article 10 through the passageways 12*b* while the solid elastic pressing members 2 and the hollow elastic pressing member 3 press the fiber molded article 10 toward the inner wall of the shaping mold 12. By sucking the water from the fiber molded article 10 through the passageways 12*b* and by pressing the fiber molded article 10 with the solid elastic pressing members 2 and the hollow elastic pressing member 3, the fiber molded article 10 is equally pressed from its inside. Thus, the fiber molded article 10 is rapidly dried and it is uniformed.

When the fiber molded article 10 is dried to a prescribed water content, the suction through the passageways 12*b* is stopped, and, at the same time, the fluid is withdrawn from the hollow elastic pressing member 3 to let the hollow elastic pressing member 3 shrink. The splits 12*a* are opened to take out the fiber molded article 10 and the pressing mold 1. One of the solid elastic pressing members 2 is detached from one end of the hollow elastic pressing member 3. The hollow elastic pressing member 3 is then is withdrawn from the fiber molded article 10 and the drying and shaping step is completed (see FIG. 4(*d*)).

If desired, the fiber molded article 10 after the drying and shaping step may be subjected to various post-treatments, such as trimming, attachment of separate parts, coating the inner and/or outer surfaces with a resin layer, printing, and water repellent treatment. In particular, after drying, by applying sodium silicate (water glass) and/or a silicone resin to the surface of the dried fiber molded article to form a sodium silicate layer and/or a silicone resin layer, a fiber molded article having high resistance to heat and water is produced.

The fiber molded article 10 produced in the present embodiment enjoys excellent shapability at every corner of each opening portion 10*a* having an increasing diameter. It is seamless, thin-walled, lightweight, uniform in thickness, and strong.

As described above, in the method of producing a fiber molded article according to the present embodiment, the pressing mold 1 having the solid elastic pressing members 2 and the hollow elastic pressing member 3 is used. The fiber layers 100 formed by papermaking on the respective splits of the papermaking mold 11 are firstly pressed by the solid elastic pressing members 2 and secondary pressed by the hollow elastic pressing member. By so doing, the opening portions 10*a* of the fiber molded article 10 and the tubular portion 10*b*. of the fiber molded article 10 are independently dewatered and shaped by the respective elastic pressing members. The resulting fiber molded hollow article 10 which has wide opening portions 10*a* each having a gradually and stepwise increasing diameter shows a precise shape and a sharpened corner shape between the steps 10*b* and the peripheral walls 10*c*.

Since the solid elastic pressing members 2 and the hollow elastic pressing member 3 are independently used to press the opening portions and the tubular portion, the hollow elastic pressing member 3 is free from extreme partial inflation and therefore exhibits markedly improved durability.

Since the shaping molds 11 and 12 for papermaking and dewatering and for drying are composed of a set of splits, any complicated cavity configuration could be formed, making it feasible to produce fiber-molded hollow articles having various complicated shapes with no design restriction.

Because the pressing mold 1 is used in the dewatering and shaping step and the drying and shaping step, transfer from the dewatering and shaping step to the drying and shaping step is performed smoothly.

The same as the dewatering and shaping step, in the drying and shaping step, the solid elastic pressing members 2 is firstly used and then the hollow elastic pressing member 3 is used. Therefore, a fiber molded article having a precise shape can be produced even if the molded article has a wide opening with a stepwise increasing diameter.

In the drying and shaping step, drying is effectively performed by pressing the fiber molded article 10 with the hollow elastic pressing member 3 in the drying mold. As a result, drying can be accomplished efficiently, and a fiber molded article having a uniform and thin wall thickness and high strength can be produced.

Figure 5A:
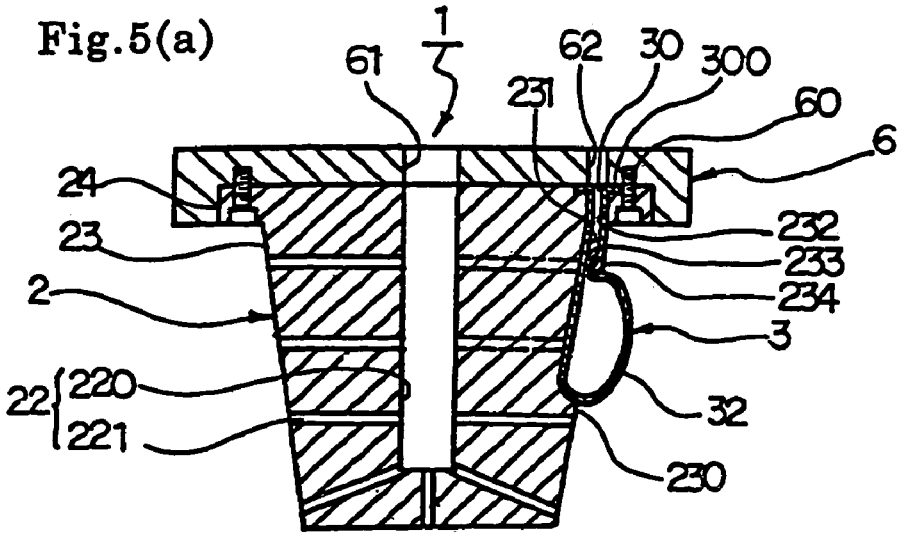
FIGS. 5(*a*) through (*c*) are schematic views of a second embodiment of the pressing mold according to the present invention; in which FIG. 5(*a*) is a side cross-section, FIG. 5(*b*) a side view, and FIG. 5(*c*) a front view.
Figure 5B:
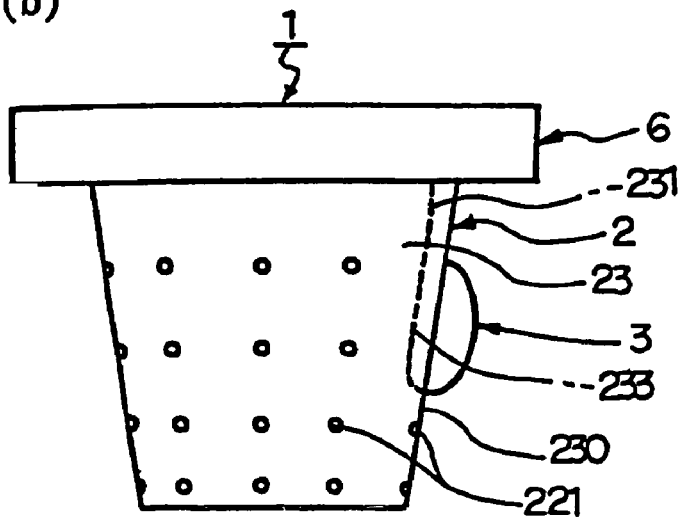
Figure 5C:
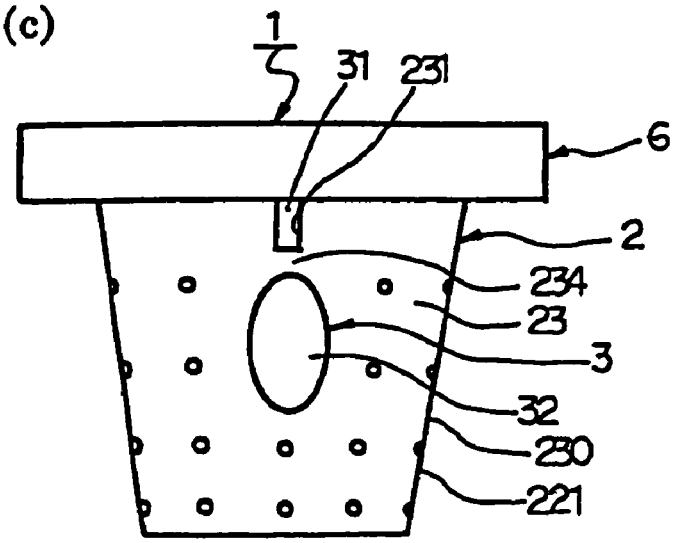

FIG. 5 shows a second embodiment of the pressing mold for producing a fiber molded article according to the present invention. The second embodiment is application of the pressing mold to production of a pulp molded cup with a handle on its body. In these figures the same parts as in the first embodiment are given the same reference numbers as in the first embodiment, and the explanation therefor is omitted here. Accordingly, the description with respect to the first embodiment are applied unless otherwise mentioned hereunder.

The pressing mold 1 according to this embodiment is set in a fiber molded article having an opening. The pressing mold 1 is used when the fiber molded article is placed in a papermaking mold or a drying mold. The pressing mold 1 presses the fiber molded article toward the inner wall of the papermaking mold or the drying mold to accomplish dewatering or drying.

The pressing mold 1 has a solid elastic pressing member 2 (i.e., a first elastic pressing member) having passageways 22 in its inside for drain of the water in of the fiber molded article and a bag-like elastic pressing member 3 (i.e., a second elastic pressing member) which is inflated by a fluid fed inside. The pressing mold 1 also has a metal-made mounting plate 6, to which the solid elastic pressing member 2 is fixed.

The solid elastic pressing member 2 has a pressing part 23 which is a downward tapered projection and a flange 24 around the top. The solid elastic pressing member 2 is fixed at its flange 24 to the mounting plate 6 with screws 60.

The pressing part 23 has, on its outer surface 230, a groove 231 which extends downwardly from the flange 24 and in which the hollow elastic pressing member 3 is fitted. The solid elastic pressing member 2 has an insertion hole 232 which leads to the upper end of the groove 231 and an insertion hole 233 which leads to the lower end of the groove 231 and opens on the outer surface 230. The portion 234 between the groove 231 and the opening of the insertion hole 233, which opens on the outer surface 230, serves as a positioning portion for an inflatable part 32 (described infra) of the hollow elastic pressing member 3.

The solid elastic pressing member 2 has a slightly smaller contour than the contour of the fiber molded article to be produced. The height of the pressing part 23 below the flange 24 is greater than the height (depth) of the fiber molded article to be produced.

The passageways 22 formed inside of the solid elastic pressing member 2 include a main passageway 220 and a plurality of branched passageways 221 branched from the main passageway 220. The main passageway 220 is formed about the center of the solid elastic pressing member 2 and extends in the vertical directions, and the branched passageways 221 radially extend from the main passageway 220 toward the outside of the solid elastic pressing member 2. The extension end of each branched passageway 221 is open on the outer surface of the pressing part 23 of the solid elastic pressing member 2 (except for the area having the groove 231 and the insertion hole 232). The area ratio of these open ends to the outer surface area of the pressing part 23 is preferably 5 to 30%, more preferably 5 to 10%, in order to achieve an efficient dewatering of the fiber molded article and to maintain the strength of the solid elastic pressing member 2 during the pressing of the fiber molded article. For the same reasons, the number of the open ends of the branched passageways 221 is preferably 1 to 4, more preferably 1 to 2, per $cm^2$ of the outer surface of the pressing part. The branched passageways 221 each have a cross-sectional area enough to secure flow of fluid even when the solid elastic pressing member 2 is elastically deformed by pressing.

The solid elastic pressing member 2 can be of any material that is elastically deformable with no particular limitation. From the viewpoint of durability and heat resistance, a pressing member made of such an elastic material as natural rubber or a synthetic rubber, e.g., urethane, fluororubber, silicone rubber or an elastomer, is preferably employed.

The hollow elastic pressing member 3 is a thin-walled elastic bag composed of a narrow tubular portion 31 extending downward from the opening 30 and an inflatable portion 32 which inflates below the tubular portion 31. A flange 300 is provided around the opening 30. The flange 300 is fixed to the upper side of the solid elastic pressing member 2 with screws (not shown) whereby the hollow elastic pressing member 3 is fixed to the solid elastic pressing member 2. The tubular portion 31 is disposed in the insertion hole 232, in the groove .231, and in the insertion hole 233 of the solid elastic pressing member 2. Only the inflatable portion 32 is exposed to the outside through the insertion hole 233.

In this way, in the present embodiment, part of the hollow elastic pressing member 3 is arranged on the outer surface of the solid elastic pressing member 2 in such a manner that the inflatable portion 32 is inflated outward from the pressing part 23 of the solid elastic pressing member 2.

Any material which shrinks and expands is usable for the hollow elastic pressing member 3 with no particular limitation. From the viewpoint of durability and heat resistance, a pressing member made of such an elastic material as natural rubber or a synthetic rubber, e.g., urethane, fluororubber, silicone rubber or an elastomer, is preferably employed.

The mounting plate 6 has a flow opening 61 which leads to the main passageway 220 and a flow opening 62 which leads to the opening 30 of the hollow elastic pressing member 3.

The pressing mold 1 having the aforementioned structure is used as follows. The solid elastic pressing member 2 presses a molded article while suction is applied to the molded article through the passageways 22 to dewater and dry the molded article. On the other hand, a fluid is fed into the hollow elastic pressing member 3, and the inflated portion 32 presses a part of the molded article. In this way, the whole inner surface of the molded article can be pressed almost uniformly with minimum thickness variation even though the molded article has a complicated shape of a protruded portion and it is dewatered and dried by pressing.

The method of producing a fiber molded article according to the present invention will then be described with reference to a preferred embodiment and drawings in which the above-described pressing mold 1 is applied to the production of a pulp molded article.

Figures 6A, 6B, 6C, 6D:
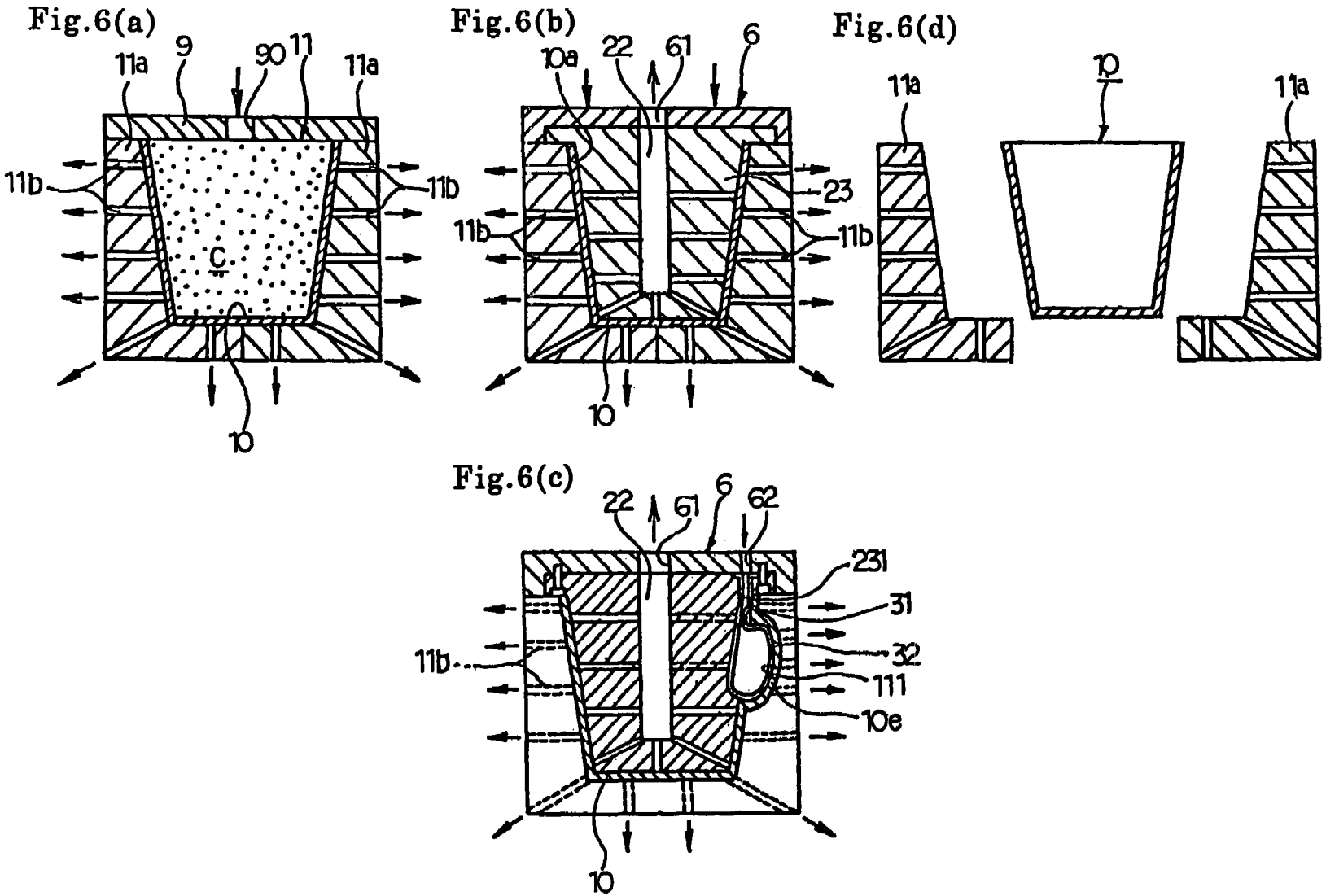
FIGS. 6(*a*) through (*d*) are schematic cross-sections of the steps for producing a fiber molded article using the pressing mold of the embodiment of FIG. 5; in which FIG. 6(*a*) shows the step of pouring a pulp slurry and papermaking, FIG. 6(*b*) shows the step of dewatering and shaping using the pressing mold 1, FIG. 6(*c*) is a partial cross-section seen from the parting face of a split in the dewatering and shaping step, and FIG. 6(*d*) is the step of removal from mold.

The step of papermaking to prepare a wet molded article is first described. In the papermaking step, a papermaking mold 11 (a shaping mold for papermaking and dewatering) is prepared. The papermaking mold 11 is composed of a pair of splits 11*a* and 11*a* which are combined to form a cavity C of prescribed shape as illustrated in FIG. 6(*a*). The inner wall of the cavity C is covered with a papermaking screen (not shown) having a prescribed mesh size. Each split 11*a* has a plurality of interconnecting passageways 11*b* which interconnect the inside (the cavity-forming surface) and the outside. Each passageway 11*b* is connected to a suction unit such as a suction pump (not shown). A nozzle plate 9 having an insertion hole 90 in conformity to an injection nozzle (not shown) for injecting a pulp slurry (fiber slurry) is put on the papermaking mold 11.

In this state, a predetermined amount of a pulp slurry is injected into the cavity under pressure. Simultaneously, the cavity C is evacuated by suction from the outside of the papermaking mold 11 through the passageways 11*b* to suck up the water of the pulp slurry. Pulp fiber is thus accumulated on the papermaking screen covering the cavity C-forming surface. As a result, a wet fiber molded article 10 is formed of the accumulated pulp fiber on the papermaking screen.

The injection pressure of the pulp slurry into the cavity C is preferably 0.01 to 1.0 MPa, more preferably 0.1 to 0.5 MPa, for achievement of an agitation effect in the cavity C. The temperature of the pulp slurry fed into the cavity C is preferably 5 to 35° C., more preferably 15 to 30° C., for prevention of an uneven thickness of the fiber molded article 10 and for reduction of other components previously recited.

After completion of forming the fiber molded article 10, the nozzle plate 9 is removed.

The wet molded article 10 thus prepared is subjected to the step of dewatering and shaping using the pressing mold 1 as shown in FIGS. 6(*b*) and (*c*). FIG. 6(*c*) is a cross-section which corresponds to (from a viewing angle) 90° rotation of the FIG. 6(*b*) around the vertical axis. In the dewatering and shaping step, the fluid paths 61 and 62 of the mounting plate 6 of the pressing mold 1 are connected to a feeding and discharging pipe (not shown) which is led to a pressurizing fluid feed source and a negative pressure source (neither shown) via switching cocks (not shown).

The hollow elastic pressing member 3 is previously evacuated to shrink the inflatable portion 32. The pressing mold 1 of this state is set in the fiber molded article 10, and the fiber molded article 10 is almost uniformly pressed by the solid elastic pressing member 2 toward the inner wall of the papermaking mold 11. On the other hand, the water of the fiber molded article 10 is sucked up through the passageways 22. At the same time, a fluid is fed into the hollow elastic pressing member 3 to inflate the inflatable portion 32 of the hollow elastic pressing member 3. In this manner, the fiber molded article 10 is dewatered and shaped by pressing the protrusion 10*e* of the fiber molded article 10 toward the inner wall of the recess 111 of the papermaking mold 11. Since the tubular portion 31 of the hollow elastic pressing member 3 is disposed in the groove 231 of the solid elastic pressing member 2, the part of the fiber molded article 10 corresponding to the groove 231 is also pressed from the inside. Thus, the fiber molded article 10 is equally pressed from its inside so that dewatering of the fiber molded article 10 proceeds with enhanced shapability.

In the present embodiment, in addition to the pressing by the solid elastic pressing member 2 and the hollow elastic pressing member 3 and the suction of the water through the passageways 22, suction of the water of the fiber molded article 10 is conducted through the passageways 11*b* of the papermaking mold 11. By these proceedings, the efficiency of dewatering of the fiber molded article 10 is improved.

The same fluid used in the first-embodiment is usable to inflate the hollow elastic pressing member 3.

To vary properties(such as density, strength, air permeability, heat insulation, etc.) of the portion of molded article pressed by the each pressing member, it is preferred to vary the pressing force of the solid elastic pressing member 2 and the hollow elastic pressing member 3. For example, to produce a fiber molded article 10 having the protrusion (handle) 10*e* of a low density and high heat insulating properties and other portion of a high density and high strength, it is preferred that the pressing force of the hollow elastic pressing member 3 is lower than that of the solid elastic pressing member 2.

When the fiber molded article 10 is dewatered to a prescribed water content, the fluid is withdrawn from the hollow elastic pressing member 3 to shrink the inflatable portion 32 of the hollow elastic pressing member 3.

The pressing mold 1 is moved upward to withdraw from the papermaking mold 11. The papermaking mold 11 is opened as shown in FIG. 6(*d*) to remove the fiber molded article 10. As stated previously, the solid elastic pressing member 2 is designed to have a slightly smaller contour than that of the fiber molded article 10. Therefore, the pressing mold 1 with its solid elastic pressing member 2 elastically restores to its original size and it can be released and withdrawn smoothly from the fiber molded article 10.

The removed fiber molded article 10 is subjected to the step of drying and shaping using the pressing mold 1. The drying and shaping step is carried out in almost the same manner as in the dewatering and shaping step shown in FIG. 6, except that papermaking and dewatering are not conducted and that a heated drying mold 12 is used.

Figures 7A, 7B, 7C, 7D:
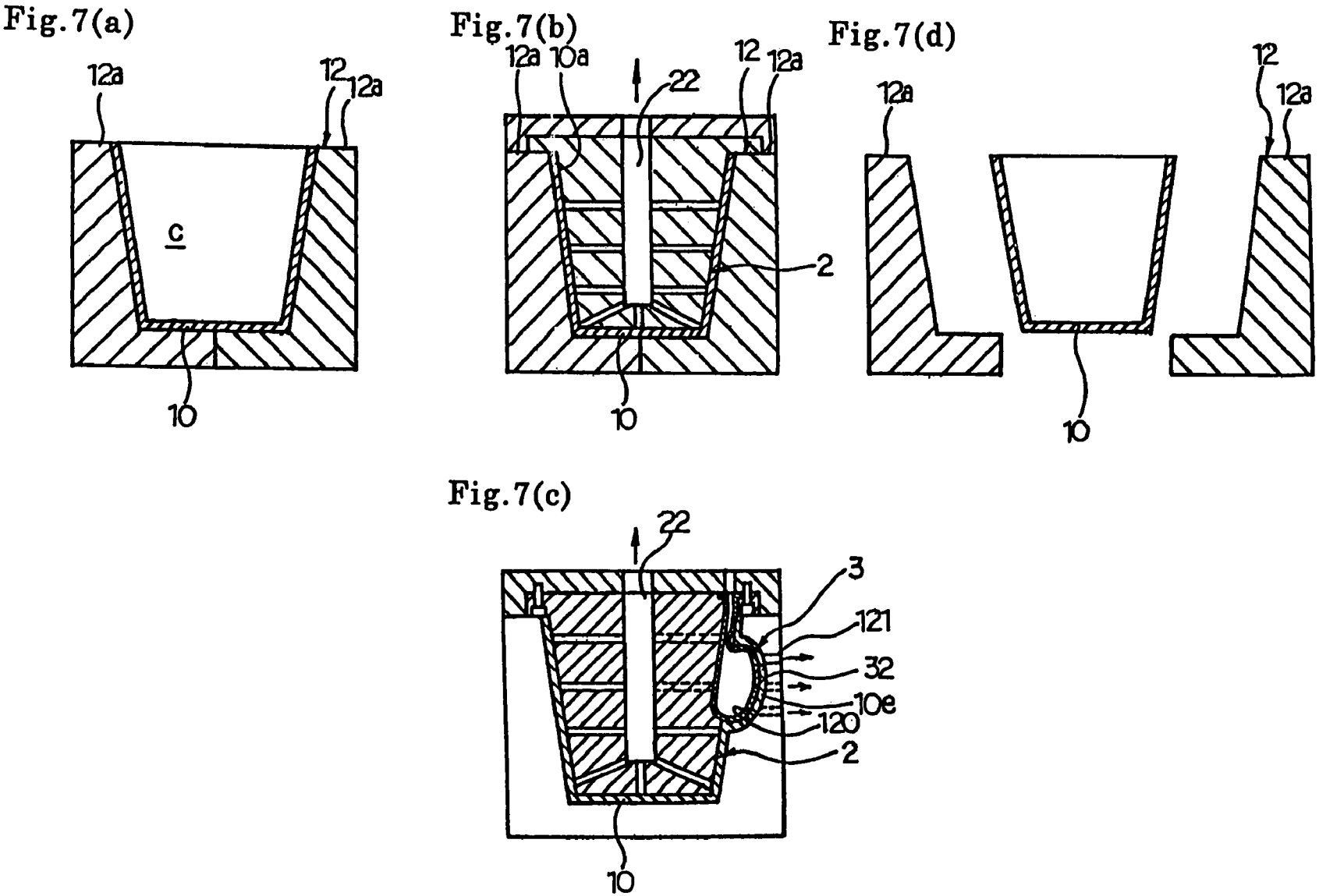
FIG. 7 show schematic views of the steps for producing a pulp molded article using the pressing mold of the embodiment of FIG. 5; in which FIG. 7(*a*) is the step of placing a molded article in a drying mold, FIG. 7(*b*) is the step of drying and shaping using the pressing mold 1, FIG. 7(*c*) is a partial cross-section seen from the parting face of a split in the drying and shaping step, and FIG. 7(*d*) is the step of removal from mold.

As shown in FIG. 7, a drying mold (a shaping mold for drying and shaping) 12 is prepared. The drying mold 12 is composed of a pair of splits 12*a* which are joined to form a cavity C in conformity with the contour of the fiber molded article 10 to be produced. The drying mold 12 is heated to a prescribed temperature by means of a heating unit (not shown) provided on or in the drying mold 12. The wet fiber molded article 10 which was dewatered to the prescribed water content is placed in the cavity C of the heated drying mold 12.

The drying mold 12 and the papermaking mold 11 used in this embodiment have approximately the same configuration with respect to the cavity C shape with the following exception. The drying mold 12 has passageways 121 for escape of steam (water) from the fiber molded article 10 in only the part having the recess 120 that faces the expandable portion 32 of the hollow elastic pressing member 3 (see FIG. 7(*c*)).

As shown in FIGS. 7(*b*) and 7(*c*) (FIG. 7(*c*) is a cross-section which corresponds to 90° rotation of the FIG. 7(*b*) around the vertical axis), the dewatered and shaped fiber molded article 10, which is in the drying mold 12, is pressed almost uniformly toward the inner wall of the drying mold 12. On the other hand, the steam (water) of the fiber molded article 10 is sucked by evacuation through the passageways 22. At the same time, a fluid is fed into the hollow elastic pressing member 3 to inflate the inflatable portion 32 of the hollow elastic pressing member 3. Thus, the fiber molded article 10 is dried while the protrusion 10*e* of the fiber molded article 10 is pressed to the inner surface of the recess 120 of the drying mold 12, which faces the inflatable portion 32. By these proceedings, the fiber molded article 10 is uniformly pressed from its inside and dried, and the shape of the cavity C of the drying mold 12 is precisely transferred to the fiber molded article 10. Since the passageways 121 are provided only in the part having the recess 120 which faces the expandable portion 32, the fiber molded article 10 which is subjected to the drying and shaping exhibits improved surface properties.

On completion of drying of the fiber molded article 10, the hollow elastic pressing member 3 is shrunk by evacuation of the fluid. The pressing mold 1 is moved upward and withdrawn from the drying mold 12. The splits 12*a* of the drying mold 12 are separated apart to remove the fiber molded article 10 as shown in FIG. 7(*d*).

Figure 8A:
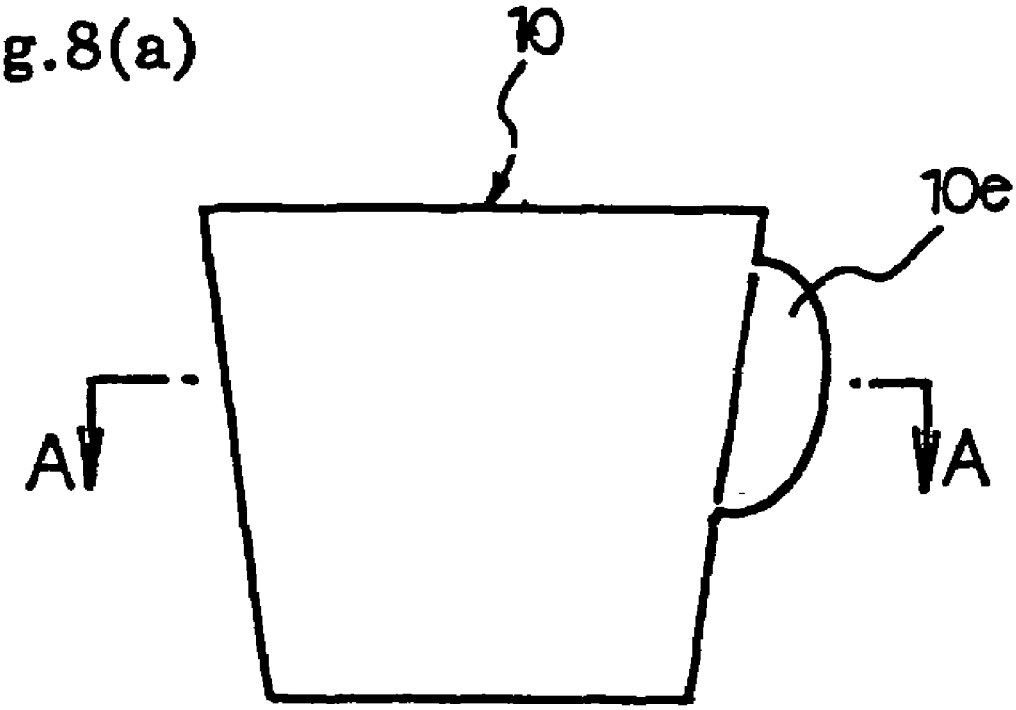
FIGS. 8(*a*) and (*b*) show a molded article obtained by the method of producing a pulp molded article using the pressing mold of the embodiment of FIG. 5, in which FIG. 8(*a*) is a side view, and FIG. 8(*b*) is a cross-sectional view on arrow A-A in (a).
Figure 8B:
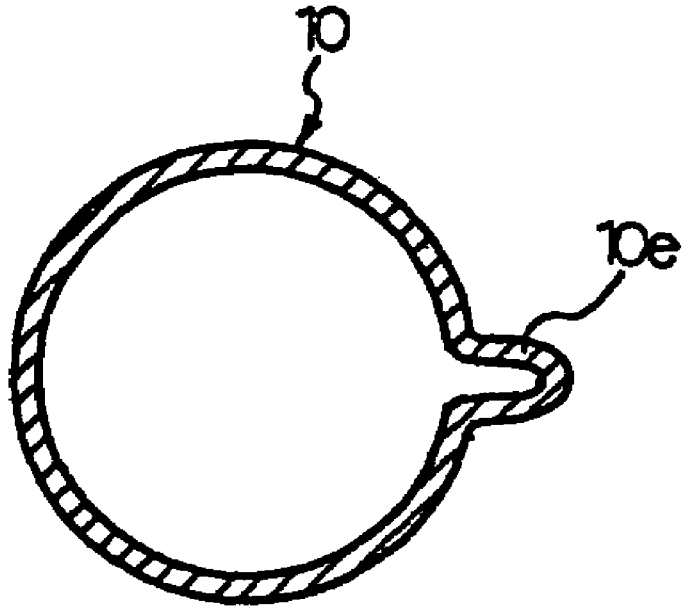

FIGS. 8(*a*) and 8(*b*) depict the appearance of the fiber molded article (cup) 10 thus produced. The whole, including the protrusion (handle) 10*e*, of the resulting fiber molded article 10 enjoys a precise shape with no substantial variation in thickness and density. Since steam is withdrawn through the passageways 22 of the pressing mold 1 during the drying and shaping with the pressing mold 1 and the drying mold 12, the resulting fiber molded article 10 has satisfactory surface properties with neither joint seams nor marks of the passageways on its body.

If necessary, the resulting fiber molded article 10 can be subjected to trimming, inner and/or outer surface lamination with a resin film by vacuum forming, pressure forming, etc., coating, printing, and like post-treatments to obtain a final production.

As described above, the pressing mold 1 and the method of producing a fiber molded article using the pressing mold 1 according to the second embodiment make possible the following matters. The fiber molded article 10 is pressed from its inside by the solid elastic pressing member 2 while the hollow elastic pressing member 3 is inflated to uniformly press the protrusion 10*e*. Accordingly, a molded article which has a protruded part like the fiber molded article 10 having the protrusion 10*e* can be uniformly press-dewatered and press-heated. As a result, variations of the thickness and density after the dewatering and drying is prevented and a fiber molded article having a precise shape is produced.

By controlling the pressing force of the solid elastic pressing member 2 and the hollow elastic pressing member 3, the physical properties(density, strength, air permeability, heat insulating etc.) of the pressed portion of the molded article 10 can easily be varied.

Figures 9A, 9B, 9C:
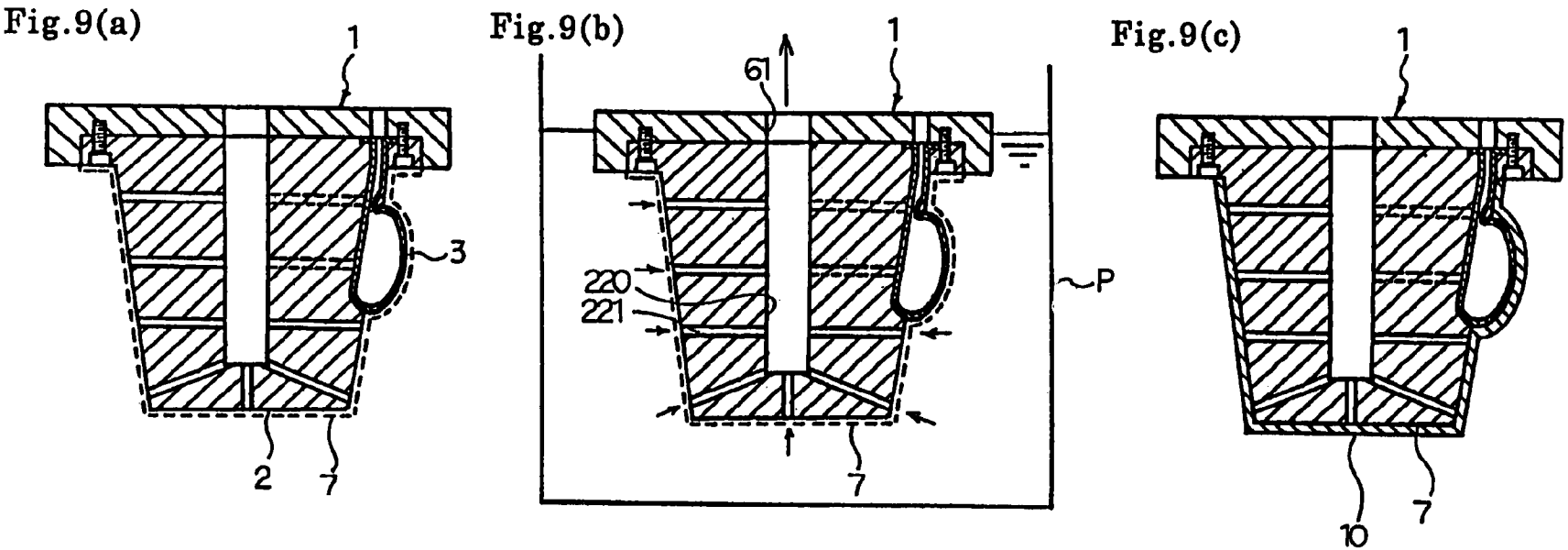
FIGS. 9(*a*) through (*c*) are schematic views of the steps of producing a fiber molded article produced by using another embodiment of the present invention; in which FIG. 9(*a*) is a cross-section of the configuration of a pressing mold, FIG. 9(*b*) depicts the step of papermaking, and FIG. 9(*c*) shows the pressing mold after being pulled out of a fiber slurry.

FIG. 9 schematically shows the step of papermaking in another embodiment of the present invention. In these figures the same parts as in the second embodiment are given the same reference numbers as in the second embodiment, and the explanation therefor is omitted here. Accordingly, the description with respect to the first embodiment is applied unless otherwise mentioned.

This embodiment provides a method of producing a fiber molded article using the pressing mold 1 of the second embodiment and employing a different method for papermaking step.

As shown in FIG. 9(*a*), in the method of producing a fiber molded article according to this embodiment, an elastically deformable (contractible and extensible) papermaking screen 7 having prescribed mesh size and wire thickness is put on the outer surfaces of the solid elastic pressing member 2 and the hollow elastic pressing member 3 of the pressing mold 1. The pressing mold 1 covered by the screen is immersed in a fiber slurry of a tank P. The water of the fiber slurry is sucked through the passageways 220, 221 and the fluid path 61 to deposit fibers and to form the fiber molded article 10 on the papermaking screen 7 as shown in FIG. 9(*c*). After forming the fiber molded article 10, the pressing mold 1 is pulled out of the fiber slurry. The pressing mold 1 having the fiber molded article 10 on its surface is transferred to the papermaking mold (shaping mold) 11, where it is dewatered and shaped by the solid elastic pressing member 2 and the hollow elastic pressing member 3 as shown in FIGS. 6(*b*) through 6(*d*). Subsequently, the pressing mold 1 with the fiber molded article 10 is put into the drying mold (shaping mold) 12 and dried and shaped with the solid elastic pressing member 2 and the hollow elastic pressing member 3 as shown in FIGS. 7(*b*) through 7(*d*).

Although the pressing mold used in this embodiment does not have passageways around the hollow elastic pressing member 3, the suction force is transmitted through between the papermaking screen and the elastic members so that the fibers are accumulated also on the part of the papermaking screen which covers the hollow elastic pressing member 3. However, where the contact area between the hollow elastic pressing member 3 and the papermaking screen is fairly large, it is desirable to dispose a liquid-permeable material, for example a coarse mesh net, between the hollow elastic pressing member 3 and the papermaking screen. By so doing, the suction force through the passageways will be transmitted more easily and the fibers accumulate with a sufficient thickness.

Figure 10:
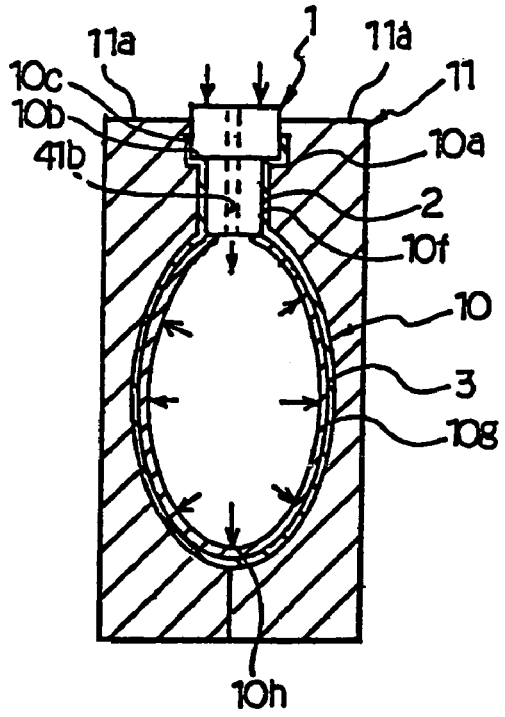
FIG. 10 is a schematic partial cross-section of another embodiment of the pressing mold according to the present invention in its state of working.
Figure 11:
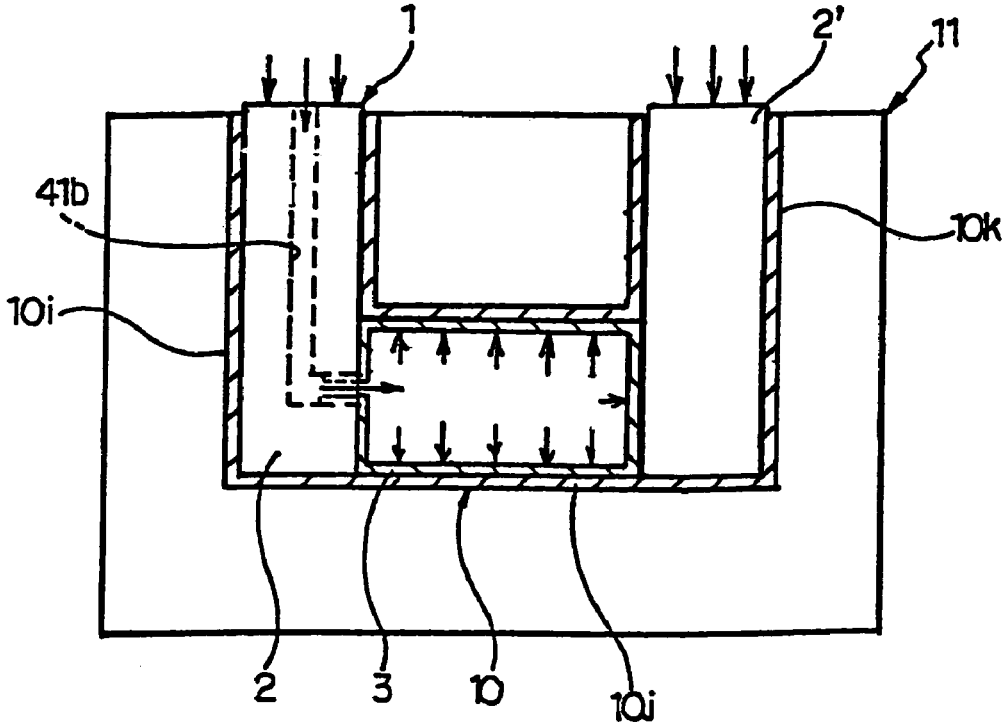
FIG. 11 is a schematic partial cross-section of still another embodiment of the pressing mold according to the present invention, seen from the parting face of a shaping mold.

FIGS. 10 and 11 show other embodiments of the pressing mold for producing a fiber molded article according to the present invention. In these figures the same parts as in the first embodiment are given the same reference numbers as in the first embodiment, and the explanation therefor is omitted here. Accordingly, the description with respect to the first embodiment applies unless otherwise mentioned.

The pressing mold 1 shown in FIG. 10 has a solid elastic pressing member 2(a first elastic pressing member) having a smaller-diametered portion 20 and a bag-like hollow elastic pressing member 3 (a second elastic pressing member). The pressing mold 1 is configured to be used in the dewatering and shaping step or the drying and shaping step for the production of a molded hollow container 10 (fiber molded article). In this embodiment, the solid elastic pressing member 2 presses the wide opening portion 10*a* and the neck 10*f* of the molded hollow container 10 from the inside toward the inner wall of a shaping mold 11, and the hollow elastic pressing member 3 presses the body 10*g* and the bottom 10*h* toward the inner wall of the shaping mold 11, thereby the dewatering and shaping step or the drying and shaping step is performed.

As described in the first embodiment, the pressing mold 1 according to the embodiment of FIG. 10 exerts such effects that a fiber molded article in the form of a container having a wide opening can be produced with precise shaping and inhibited of the wall thickness and density.

The pressing mold shown in FIG. 11 has a solid elastic pressing member 2 (a first elastic pressing member) and a bag-like hollow elastic pressing member 3 (a second elastic pressing member) and is configured to be used for dewatering and shaping or drying and shaping in the production of a fiber molded hollow article 10 having a U-shaped cross-section. According to this embodiment, the solid elastic pressing member 2 is adapted to press one of the vertical tubular portions 10*i* from the inside toward the inner wall of a shaping mold 11, and the hollow elastic pressing member 3 is adapted to press the horizontal tubular portion 10*j* toward the inner wall of the shaping mold 11. Additionally, another solid elastic pressing member 2' is provided to press the other vertical tubular portion 10*k* toward the inner wall of the shaping mold 11. In this way, the fiber molded article is dewatered and shaped or dried and shaped.

Similar to the pressing mold of the first embodiment, the pressing mold 1 according to the embodiment of FIG. 11 enables to produce a fiber molded article having a complicated shape with high precise shaping and inhibited variations of the wall thickness and density.

The present invention is not limited to the above-recited embodiments, and appropriate changes or modifications can be made therein without departing from the spirit and scope thereof.

For example, the shapes of the first and second elastic pressing members and the set position of these pressing members are changed according to the shape of the molded article to be dewatered or dried. For instance, in the first embodiment, the smaller-diametered part and the side tapering of the first elastic pressing member could be omitted in consideration of the necessity.

Two or more second elastic pressing members could be provided on the pressing part of the first elastic pressing member.

In carrying out the method of producing a fiber molded article according to the present invention, it is preferred to use the pressing mold both of the dewatering step and the drying step as in the method using the pressing mold of the first embodiment. However, the pressing mold is used only in the dewatering step or in the drying step.

The papermaking step of the second embodiment employs the method that the pulp slurry is fed into the cavity formed by coupling of the splits. Other papermaking steps can be employed, for example, a method that a papermaking mold composed by coupling of each split is immersed in a pulp slurry and the slurry is sucked to form a molded article on the inner surface of the papermaking mold, or that each split is immersed in a pulp slurry and a partial molded article is formed on the each inner surface of the splits to suck the slurry through passageways of the each split and the splits are mated and further the pulp slurry is fed into a cavity formed by the mating of the each split to form a unitary molded article.

In carrying out the method of producing a fiber molded article according to the present invention, it is preferred that the cavity of a papermaking mold and that of a drying mold have the same shape as described in the first embodiment. It is also possible to use a papermaking mold and a drying mold having different cavity configurations. For example, the cavity of the drying mold is partially larger than the cavity of the papermaking mold and in the drying step, an elastic pressing member of the pressing mold is inflated to press a dewatered wet molded article to the inner wall of the larger part of the drying mold cavity to deform and dry the molded article.

In the method with use of the pressing mold of the first embodiment, the papermaking mold and the drying mold are each composed of a pair of splits (two halves) having a mirror image. It is also possible to use a papermaking mold or a drying mold which is composed of a set of two or more splits depending on the shape of a molded article to be produced.

Some shapes could be molded without using a split mold but using an integral mold (non split type mold). In this case the resulting molded article, having no parting lines on its outer surface, exhibits excellent appearance and printability.

It is preferred that dewatering and shaping, or drying and shaping is firstly performed with the solid elastic pressing member 2 and the same step is followed with the hollow elastic member 3 as described in the first embodiment. In case that water escape and air escape are deemed to be important, the hollow elastic pressing member 3 may be firstly used and the solid elastic pressing member 2 may be secondary used. In this case, the pressing operation is preferably carried out by feeding a fluid into the hollow elastic pressing member 3 under a low pressure of 0.01 to 0.2 MPa, then pressing the molded article with the solid elastic pressing member 2, and finally feeding the fluid into the hollow elastic pressing member 3 under a high pressure of 0.1 to 5MPa. By controlling the fluid feed pressure and the pressing force of the hollow elastic pressing member and the solid elastic pressing member in this way, the hollow elastic pressing member is prevented from entering between fiber layers and the solid elastic pressing member.

The pressing mold and the method of producing a fiber molded article using the pressing mold according to the present invention are applicable to production of any fiber molded article with no particular restriction as long as the fiber molded article has a protruded portion, a larger-diametered portion or a smaller-diametered portion. Needless to say, they are also applicable to production of other fiber molded articles than the hollow tubular fiber molded article, the cup, and the hollow container according to the aforementioned embodiments. For example, they are useful to produce air conditioning ducts, industrial parts such as wire ducts, fragrance containers having a highly air-permeable part, and housings for appliances such as telephones.

INDUSTRIAL APPLICABILITY

The pressing mold and the method for producing a fiber molded article according to the present invention provide a fiber molded article with a protruded portion or a wide opening portion with a precise shape and minimized variation in thickness and density. The pressing mold of the present invention has excellent durability.

The invention claimed is:

1. A method of producing a fiber molded article using a pressing mold, the method comprising the steps of:

inserting a first split and a second split into a slurry tank such that a fiber layer is formed on the first split and a fiber layer is formed on the second split;

placing the pressing mold, which includes a solid elastic member and an inflatable elastic member configured to be inflated, onto the fiber layer on the first split;

joining the first split and the second split such that a fiber molded article is formed from the fiber layer on the first split and the fiber layer on the second split; and dewatering and shaping the fiber molded article by pressing the fiber molded article by the solid elastic pressing member toward an inner surface of a first shaping mold formed by the joining the first split and the second split, and feeding a fluid into the inflatable elastic pressing member to press a part of the fiber molded article toward the inner surface of the first shaping mold.

2. The method of producing a fiber molded article according to claim 1, wherein the solid elastic pressing member shapes an opening portion of the fiber molded article, and the inflatable elastic pressing member shapes a part of the fiber molded article that does not include the opening portion.

3. The method of producing a fiber molded article according to claim 1, wherein the start of dewatering and shaping with the solid elastic pressing member is followed by the start of dewatering and shaping with the inflatable elastic pressing member.

4. The method according to claim 1, further comprising:

after the dewatering and shaping, removing the fiber molded article from the first shaping mold without removing the press mold;

placing the fiber molded article and the press mold in a second shaping mold; and drying and shaping the fiber molded article by pressing the fiber molded article by the solid elastic pressing member toward an inner surface of the second shaping mold, and inflating the inflatable elastic pressing member to press the part of the fiber molded article toward the second shaping mold.

5. The method according to claim 4, wherein the drying and shaping the fiber molded article includes heating the second shaping mold.

6. The method according to claim 1, wherein the placing the pressing mold includes placing the pressing mold, which includes at least two solid elastic members, onto the fiber layer on the first split.

7. The method according to claim 6, wherein the placing the pressing mold includes attaching a first solid elastic pressing mold to a first end of the inflatable elastic pressing mold and attaching a second solid elastic pressing mold to a second end of the inflatable elastic pressing mold.

8. The method according to claim 1, wherein the dewatering and shaping includes feeding the fluid into the inflatable elastic pressing member via a hole in the solid elastic pressing member.

9. A method of producing a fiber molded article using a pressing mold, the method comprising the steps of:

immersing the pressing mold, which includes coupled splits, into a pulp slurry such that a fiber layer is formed on a first split and a fiber layer is formed on a second split;

placing the pressing mold, which includes a solid elastic member and an inflatable elastic member configured to be inflated, onto the fiber layer on the first split;

joining the first split and the second split such that a fiber molded article is formed from the fiber layer on the first split and the fiber layer on the second split; and dewatering and shaping the fiber molded article by pressing the fiber molded article by the solid elastic pressing member toward an inner surface of a first shaping mold formed by the joining the first split and the second split, and feeding a fluid into the inflatable elastic pressing member to press a part of the fiber molded article toward the inner surface of the first shaping mold.

* * * * *